United States Patent [19]

Bromberg

[11] 4,323,609

[45] Apr. 6, 1982

[54] ROTATABLE WHEEL ASSEMBLY

[75] Inventor: Howard M. Bromberg, Bronx, N.Y.

[73] Assignee: The Flexi-Group Inc., New York, N.Y.

[21] Appl. No.: 944,272

[22] Filed: Sep. 21, 1978

[51] Int. Cl.[3] ..... G09F 11/04

[52] U.S. Cl. ..... 428/65; 40/495; 235/78 R

[58] Field of Search ..... 35/74; 40/113-115, 40/495; 428/64, 63, 65, 137-140; 235/78 R, 78 A, 78 F, 78 G, 78 M, 78 N, 78 RC

[56] References Cited

U.S. PATENT DOCUMENTS

| | | | |
|---|---|---|---|
| 784,974 | 3/1905 | Biggs | 40/113 |
| 2,016,445 | 10/1935 | Massey | 40/495 |
| 2,386,082 | 10/1945 | Attridge | 40/495 X |
| 2,932,104 | 4/1960 | Corbett | 428/64 X |
| 3,103,080 | 9/1963 | Desmond | 40/495 |
| 3,194,717 | 7/1965 | Albert | 428/137 X |
| 3,321,858 | 5/1967 | Bailey | 40/495 |
| 3,468,037 | 9/1969 | Warneke | 35/9 R |
| 3,471,956 | 10/1969 | Walters | 40/495 |
| 3,604,134 | 9/1971 | Clark | 40/495 |
| 3,718,519 | 2/1973 | Montgomery | 428/65 X |
| 3,820,263 | 6/1974 | Clark | 40/495 |
| 3,939,586 | 2/1976 | Clark | 40/495 |
| 4,008,533 | 2/1977 | Greenberger | 40/495 |

*Primary Examiner*—Henry F. Epstein

*Attorney, Agent, or Firm*—Philip Rodman

[57] ABSTRACT

The rotatable wheel assembly includes a wheel member rotatably sandwiched between a pair of cover members. Grommetless securing means are provided on at least one of the cover members for securing it to the other cover member through an axial opening in the wheel member. The grommetless securing means, which in one embodiment constitute an adhesive patch formed on at least one of the cover members, also function as a pivot for rotation of the wheel member with respect to the cover members. In other embodiments of the invention, the grommetless securing means comprise an adhesive patch member, which can be formed as an appendage to one of the cover members, that spans an opening in one of the cover members to adhere to the other cover member through the axial wheel opening. In a further embodiment of the invention the grommetless securing means comprise tab members formed on one of the cover members to extend through the axial wheel opening and a tab reception opening in the other cover member for folding thereon. A sheet construction for the rotatable wheel assembly includes the wheel member and cover member in side-by-side relationship with separation and fold lines to facilitate arrangement of the construction into a rotatable wheel assembly. Mass production of the construction blank can be accomplished on a web wherein all separation and fold lines lie in the direction of movement of the web.

25 Claims, 25 Drawing Figures

Fig.1.
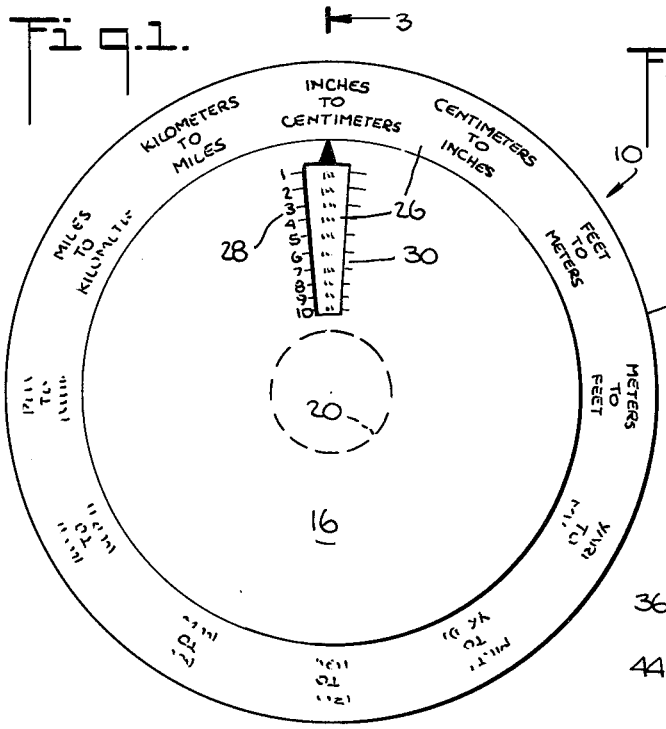
Fig.2.
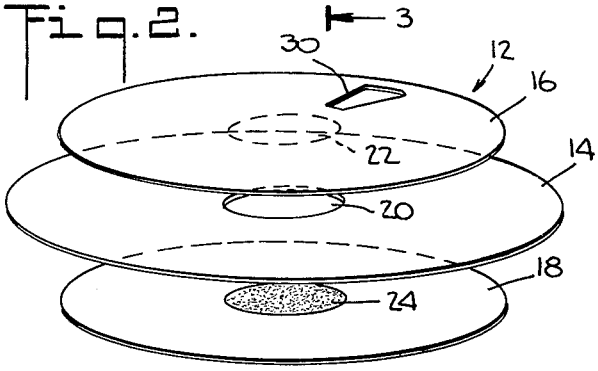
Fig.3.
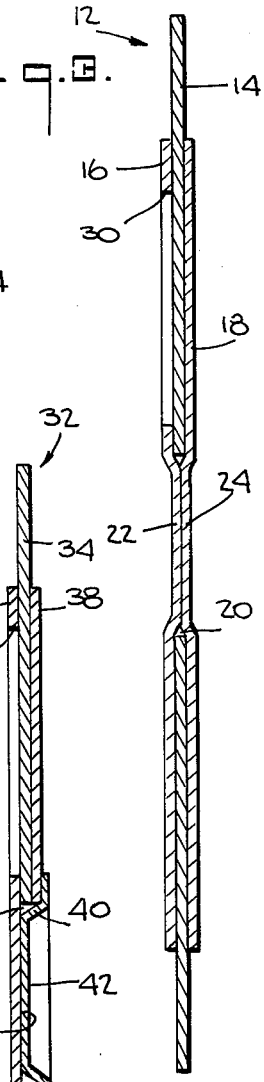
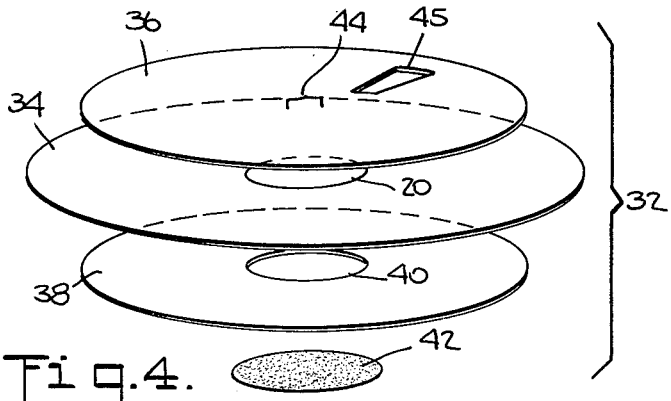
Fig.4.
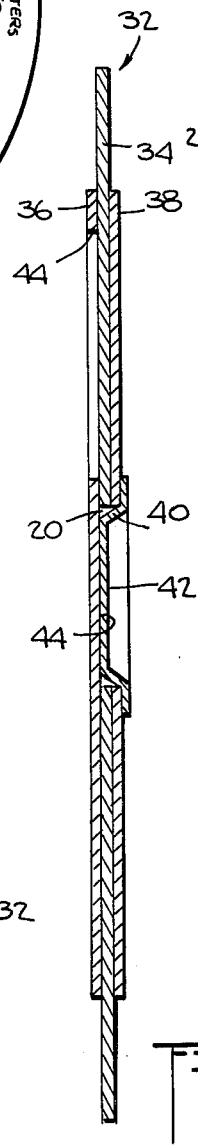
Fig.5.

ROTATABLE WHEEL ASSEMBLY

This invention is directed to wheel calculators and more particularly to a novel rotatable wheel assembly employed in a wheel calculator, a novel construction for a rotatable wheel assembly and a novel method of making a rotatable wheel assembly.

Wheel calculators are well known handy informational tools that can be adapted to furnish a variety of data in an easily understandable format. Since the utility of wheel calculators as an informational tool helps assure their preservation, wheel calculators are also effectively used for promotional purposes such as advertising.

A typical wheel calculator usually comprises at least two discs secured to each other by a pivot arrangement, such as a grommet, that enables one disc to rotate with respect to the other disc.

The term grommet as used herein refers to any pivot structure for the wheel assembly that is distinct from other components of the wheel assembly and separately definable as a pivot member.

One of the discs in a wheel calculator, normally characterized as the wheel, includes an array of data having a predetermined format while the other disc, normally characterized as the readout disc, contains an opening or display window that frames distinct portions of the wheel data depending upon the rotational position of the wheel relative to the display window.

The term wheel as used herein refers to any generally circular structure as well as hexagons, pentagons and other such multi-sided geometrical figures.

The user of the wheel calculator moves the wheel to one of several selectable positions wherein the window readout yields data that is correlated with data on the readout disc for easy interpretation by the user.

Some known wheel calculator arrangements include an additional disc to stabilize the rotational movement of the wheel or to accommodate additional data, or for other known suitable calculator purposes.

Due to a continual escalation in manufacturing cost, the expense of a large gratuitous distribution of wheel calculators by an advertiser, merchant or promoter is often onerous. Since advertising usually requires high volume exposure that translates into large numbers of calculators, advertisers often face a cost dilemma that may necessitate the charging of a nominal fee for the wheel calculator. However, while consumers may be willing to pay a fee for magazines, newpapers or other such periodicals which carry advertising, they demonstrate great reluctance to pay for devices such as wheel calculators, despite the recognized utility of such calculators. Therefore, the employment of wheel calculators as an advertising medium has not been widely resorted to by well-known national advertisers.

It is thus desirable to provide a rotatable wheel assembly for a wheel calculator that can be manufactured at a low enough cost to make feasible large gratuitous offerings of the wheel calculator by national advertisers, merchants or promoters.

Among the several objects of the present invention may be noted the provision of a novel rotatable wheel assembly, a novel rotatable wheel assembly that is assembled without grommets, a novel rotatable wheel assembly having a foldable wheel member, a novel construction for a rotatable wheel assembly comprising a single sheet member having printed matter on one surface only, a novel construction for a rotatable wheel assembly having an appendage for joining the assembly to a journal such as a newspaper or magazine, and a novel method of making a rotatable wheel assembly.

The present invention relates to a novel rotatable wheel assembly used in a wheel calculator. In each of the disclosed embodiments of the invention the rotatable wheel assembly includes a generally flat wheel member sandwiched between a pair of generally flat oppositely disposed cover members. The wheel member has an axial opening that encompasses an axis of rotation and grommetless securing means are provided on at least one of the cover members for securing it to the other cover member through the axial opening in the wheel member. The grommetless securing means also function as a pivot for rotation of the wheel member with respect to the cover members.

In one embodiment of the invention the grommetless securing means comprise an adhesive patch formed on at least one of the cover members in alignment with the axial opening in the wheel member. The patch is thus adhered to the other cover member through the axial opening in the wheel member.

In another embodiment of the invention one of the cover members is formed with an opening in substantial alignment with the axial opening in the wheel member. The grommetless securing means comprise a separate adhesive patch member applied over the cover member opening for adherence to the other cover member through the axial opening in the wheel member.

In still another embodiment of the invention, the grommetless securing means include a foldable flap formed as an appendage to one of the cover members. The flap includes an adhesive portion that aligns with a cover member opening when the flap is in its folded position. The adhesive portion thus adheres one cover member to the other cover member through the axial opening in the wheel member.

In a further embodiment of the invention one of the cover members is formed with tab members that align with and extend through the axial opening in the wheel member and a tab reception opening in the other cover member. The tabs are folded onto the other cover member and thus function as a grommetless securing means for the cover members as well as a pivot means for permitting rotation of the wheel member with respect to the cover members.

In either of the preceding embodiments of the invention, the cover members can be formed with a common joined edge portion that is folded to place the cover members in their assembled position substantially parallel to each other. The wheel member can comprise a pair of wheel segments layered against each other. A common edge portion can hinge the wheel segments together.

A construction for the rotatable wheel assembly is made from a sheet of generally flat flexible foldable material wherein the wheel member and the pair of cover members are formed in integral side-by-side relationship. A fold line is provided between the cover members, and a detachable disposable strip member having separation lines is defined between the wheel member and the cover members. The strip member can be folded to form an attachment appendage for securing the construction to the binding of a magazine or other periodical. The fold line and separation lines in this construction are parallel to each other.

The construction for the rotatable wheel assembly is preferably made in quantity from a web that moves in the direction of the separation and fold lines, thereby permitting simultaneous and continuous formation of the separation and fold lines prior to cutting of the web into individual construction blanks.

The invention accordingly comprises the constructions and methods hereinafter described, the scope of the invention being indicated in the following claims.

In the accompanying drawings, in which various possible embodiments of the invention are shown:

FIG. 1 is a plan view of a wheel calculator incorporating one embodiment of the rotatable wheel assembly;

FIG. 2 is an exploded view thereof;

FIG. 3 is a sectional view thereof taken on the line 3—3 of FIG. 1;

FIG. 4 is an exploded view of another embodiment of the invention;

FIG. 5 is a sectional view thereof in assembled condition;

Corresponding reference characters indicate corresponding parts throughout the several views of the drawings.

Figures 6, 7, 8, 9, 10, 11:
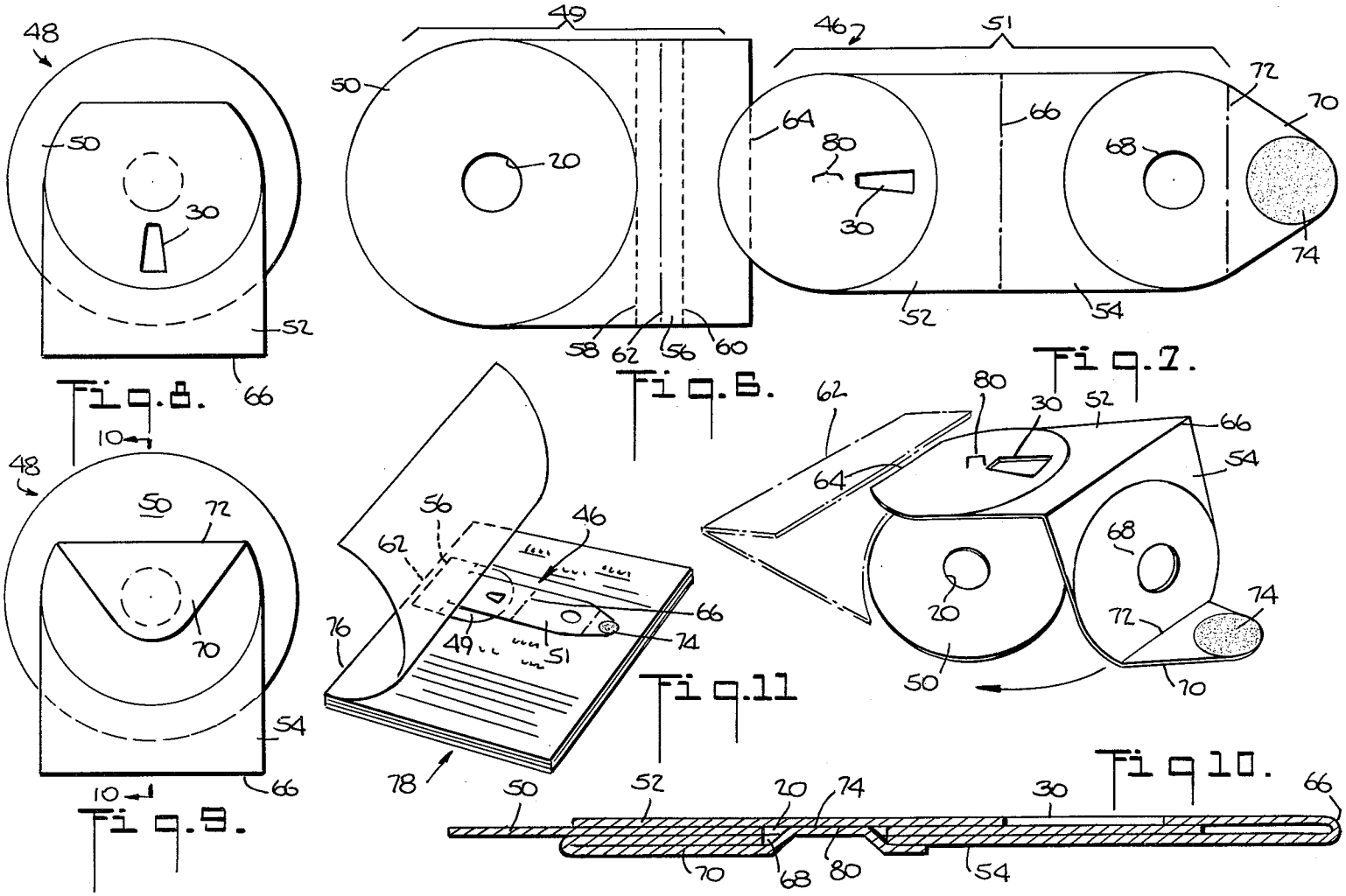
FIGS. 6 through 9 show the construction and assembly of another embodiment of the invention.
FIG. 10 is a sectional view taken on the line 10—10 of FIG. 9.
FIG. 11 shows the construction of FIGS. 6 through 9 partially folded and secured to the binding of a journal.

Referring now to the drawings a wheel calculator, generally indicated by reference number 10 in FIG. 1 incorporates one embodiment of a rotatable wheel assembly 12 shown in expolded fashion in FIG. 2. All embodiments of the rotatable wheel assembly described herein are formed of any suitable, flexible, foldable material such as paper or paperboard, plastic film or sheeting.

The rotatable wheel assembly 12 comprises a substantially flat, generally circular wheel member 14 sandwiched between a pair of oppositely disposed parallel cover members 16 and 18.

The wheel member 14 has a circular axial opening 20 which encompasses a central axis of rotation for the wheel member 14.

Each of the cover members 16 and 18 is provided with a circular adhesive patch 22 and 24 of any suitable known adhesive. The adhesive patches 22 and 24 can be of smaller area than the axial opening 20 of the wheel member 14 and align with said axial opening. The adhesive patches 22 and 24 are pressed together to bond to each other through the axial opening 20 as shown in FIG. 3.

Under this arrangement the adhesive bond between the cover members 16 and 18 serves as a pivot for rotation of the wheel member 24 with respect to the cover members 16 and 18, and is also the means for securing the cover members together.

If desired a coating of any suitable bond resistant material can be applied to the peripheral area of the axial opening 20 of the wheel member 14.

The cover members 16 and 18, when formed of plastic film or sheeting can omit the adhesive patches 22 and 24 and be heat sealed through the axial opening 20 in the general areas represented by the adhesive patches 22 and 24.

It will be apparent that the disclosed securing means, namely the adhesive patches 22 and 24 or the heat sealed portions of the cover members are integral parts of the cover members 16 and 18 and are not separately definable as a pivot member apart from the environment of the cover members.

The rotatable wheel assembly 12 thus eliminates the well-known grommet (not shown) that is conventionally used for securing the discs of a wheel calculator together and which grommet conventionally serves as a pivot member for the wheel of a wheel calculator. While the grommet of a conventional wheel calculator is ordinarily distinct from other components of the wheel calculator and is separately definable as a pivot member, the adhesive patches 22 and 24 have no such separate distinctiveness.

The rotatable wheel assembly 12 is incorporated into the wheel calculator 10 by providing indicia 26 on the wheel member for correlation with indicia 28 and a readout window 30 that are provided on the cover member 16. The wheel calculator 12 can be used, for example, to furnish a quick and easy conversion from Metric units to English units and vice-versa.

The wheel member 14 has a first predetermined position with respect to the readout window 30, such as shown in FIG. 1, for providing a conversion from inches to centimeters. Another predetermined position of the wheel member 14 with respect to the readout window 30 provides a conversion from kilometers to miles. Any change in adjustment of the wheel calculator to obtain a desired conversion of units is accomplished by grasping the cover members 16 and 18 in one hand and rotating the wheel member 14 with respect to the cover members, to the appropriately designated position.

Surface portions of the cover member 16, as well as the cover member 18, that are used for data correlation with the wheel member 14 can carry an advertisement or can be utilized for other suitable promotional purposes. If desired each opposite surface of the wheel member 14 can include indicia, as well as the cover member 18 which can also be provided with a readout window (not shown) for cooperation with indicia that appears on a corresponding surface of the wheel member 14.

Figure 17:
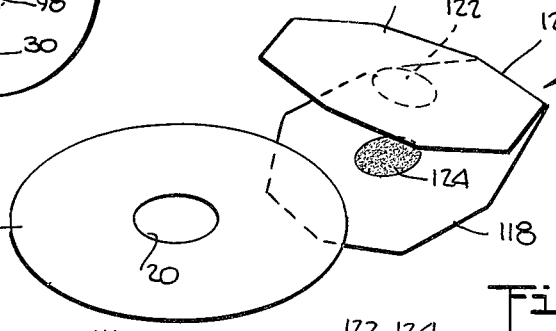
FIGS. 17 and 18 show another embodiment of the invention.
Figure 18:
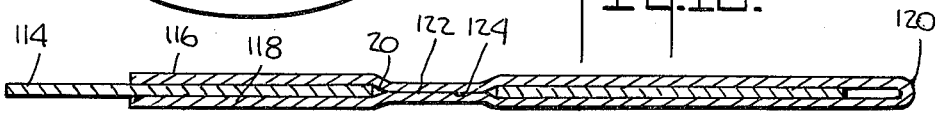

In another embodiment of the invention shown in FIG. 17 a rotatable wheel assembly 112 includes a wheel member 114 identical to the wheel member 14, and sandwiched between a pair of cover members 116 and 118 that are hinged together at a common edge portion 120. The cover members 116 and 118 each include a respective adhesive patch 122 and 124 arranged to bond to each other through the axial opening 20 of the wheel member 114 as shown in FIG. 18.

The commonly joined edge portion 120 of the cover members 116 and 118 is at a greater predetermined distance from the axis of rotation of the wheel member 114 than the maximum radial extent of the wheel member 114 from said axis of rotation.

In another embodiment of the invention, shown in FIG. 4, a rotatable wheel assembly 32 includes a wheel member 34 identical to the wheel member 14, sandwiched between a pair of cover members 36 and 38. While the cover member 36 is similar to the cover member 16, the cover member 38 is formed with an opening 40 that aligns with the axial opening 20 of the wheel member 34. The cover member opening 40 can be the same diameter as or slightly smaller than the axial opening 20.

A circular patch member 42 of greater diameter than the cover member opening 40 is coated with adhesive and placed on the cover member 38 spanning the cover member opening 40. The cover member 36 is registered with the cover member 38 and secured at a predetermined securance portion 44 to the patch member 42 through the axial opening 20 of the wheel member 14 as shown in FIG. 5. Provision of adhesive on the securance portion 44 is optional. The adhesive bond between the patch member 42 and the securance portion 44 of the cover member 38 serves as a pivot for rotation of the wheel member 34 with respect to the cover members 36 and 38, and secures said cover members together.

A readout window 44 similar to the readout window 30 is provided in the cover member 36. Appropriate indicia (not shown) can be provided on the wheel member 34 and the cover members 36 and 38 as previously described with respect to the rotatable wheel assembly 12, to provide a wheel calculator analogous to the wheel calculator 10.

A construction blank 46 for a rotatable wheel assembly 48 incorporating another embodiment of the invention is shown in FIG. 6. The construction 46 comprises a first leaf portion 49 that includes a wheel member 50 alongside a second leaf portion 51 that includes a pair of cover members 52 and 54.

The wheel member 50 is identical to the wheel member 14 and includes the axial opening 20. A strip member 56, formed on the leaf portion 49 between the wheel member 50 and the cover member 52, is defined by separation lines 58 and 60 extending across opposite sides of the construction 46. A strip fold line 62 is formed between the separation lines 58 and 60 in parallel relationship therewith. The leaf portion 51 is joined to the leaf portion 49 at a separation line 64 that is a secant of the cover member 52. It should be noted that the term "fold line" does not necessarily denote a printed line but can be any impression or other suitable formation in the construction to facilitate folding.

The cover members 52 and 54 are joined at a fold line 66. The cover member 54 has an opening 68 and includes a flap 70 formed as an appendage to the cover member 54 for folding along a fold line 72. The flap 70 has a generally circular adhesive area 74 of greater diameter than the cover member opening 68.

The construction 46 is foldable along the strip fold line 62 to permit the folded strip member 56 to form an attachment appendage securable to the binding 76 of a journal 78 as shown in FIG. 11.

The construction 46 is then removable from the binding 76 by tearing along the separation lines 58 and 60 of the strip member 56. This frees and separates the leaf members 49 and 51. If the construction 46 is not to be distributed in a journal 78 the strip member 56 is optional and can be omitted as shown in FIG. 7.

To assemble the construction 46, the leaf portions 49 and 51 are separable at the separation line 64. The circular wheel member 50 is cut, with a scissors for example, from the leaf portion 49 and placed between the cover members 52 and 54 which are folded along the fold line 66 to remain hinged together at said fold line. The flap 70 is folded at 72 as shown in FIG. 7 to enable the adhesive area 74 to attach to a securance portion 80 of the cover member 52 through the axial opening 20 of the wheel member 50. The adhesive bond between the flap 70 and the cover member 52 serves as pivot for rotation of the wheel member 50 with respect to the cover members 52 and 54, and secures the cover members 52 and 54 together.

It will be noted that the axial opening 20, the cover member opening 68 and the securance portion 80, which can have an optional adhesive coating, are in a colinear arrangement in the construction 46. Moreover, the cover member fold line 66 is at a predetermined greater distance from the axis of rotation of the wheel member 50 than the maximum radial extent of the wheel member 50 from said axis of rotation.

Figure 14:
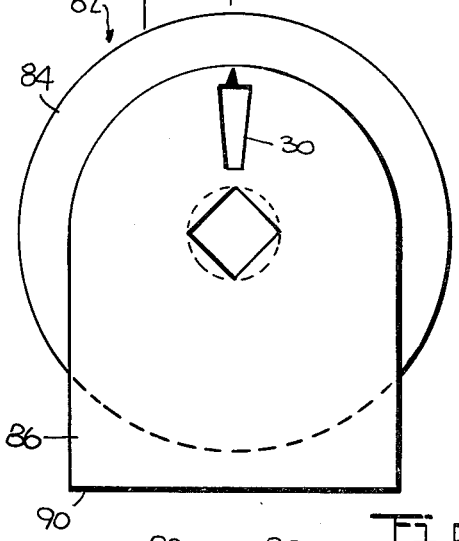
FIGS. 12 through 15 show the construction and assembly of another embodiment of the invention.
Figure 15:
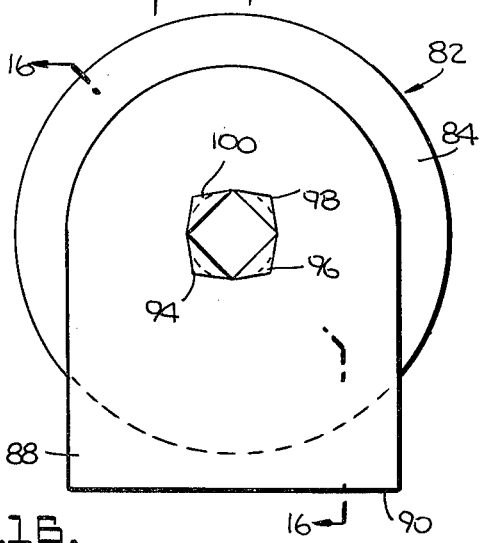
Figure 16:
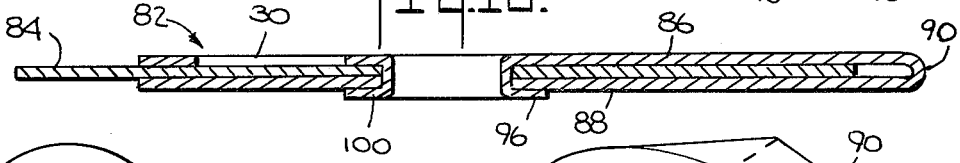
FIG. 16 is a sectional view taken on the line 16—16 of FIG. 15.
Figure 12:
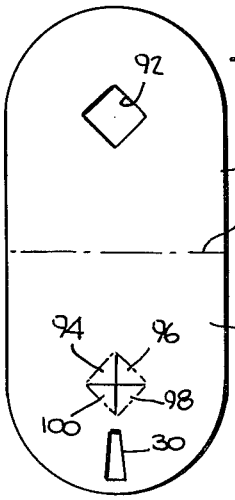
Figure 13:
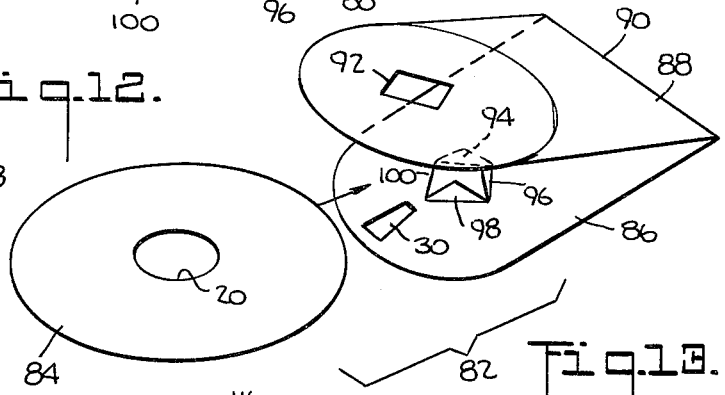

Another embodiment of the rotatable wheel assembly, indicated by reference number 82, is shown in FIGS. 14 through 16. The rotatable wheel assembly 82, which is also shown in its preassembled form in FIGS. 12 and 13, includes a wheel member 84, identical to the wheel member 14, sandwiched between a pair of cover members 86 and 88. The cover members 86 and 88 are hinged together at a common edge portion 90. A square tab reception opening 92 is formed in the cover member 88 and a cross-cut that registers with, and is substantially equivalent to the diagonals of the square opening 92 is provided in the cover member 86 to form four generally triangular tab members 94, 96, 98 and 100. The diagonals of the square opening 92 are substantially equivalent to or slightly less than the diagonal of the axial opening 20 in the wheel member 84.

The tab members 94, 96, 98 and 100 align with and extend through the wheel member axial opening 20 and the square tab reception opening 92 of the cover member 88. As shown in FIGS. 15 and 16, the tab members 94, 96, 98 and 100 are folded onto the cover member 88 to secure the cover members 86 and 88 together.

The tabular connection between the cover members 86 and 88 also serves as a pivot for rotation of the wheel member 84 with respect to cover members 86 and 88. If desired, the folded tab members 94, 96, 98 and 100 can be bonded or otherwise attached to the cover member 88 after they have been folded thereon. As indicated for previous embodiments having cover members with common joined edges, the common joined edge portion 90 is at a greater predetermined distance from the axis of rotation of the wheel member 84 than the maximum radial extent of said wheel member from said axis of rotation.

Figures 19, 20, 21, 22, 23, 24, 25:
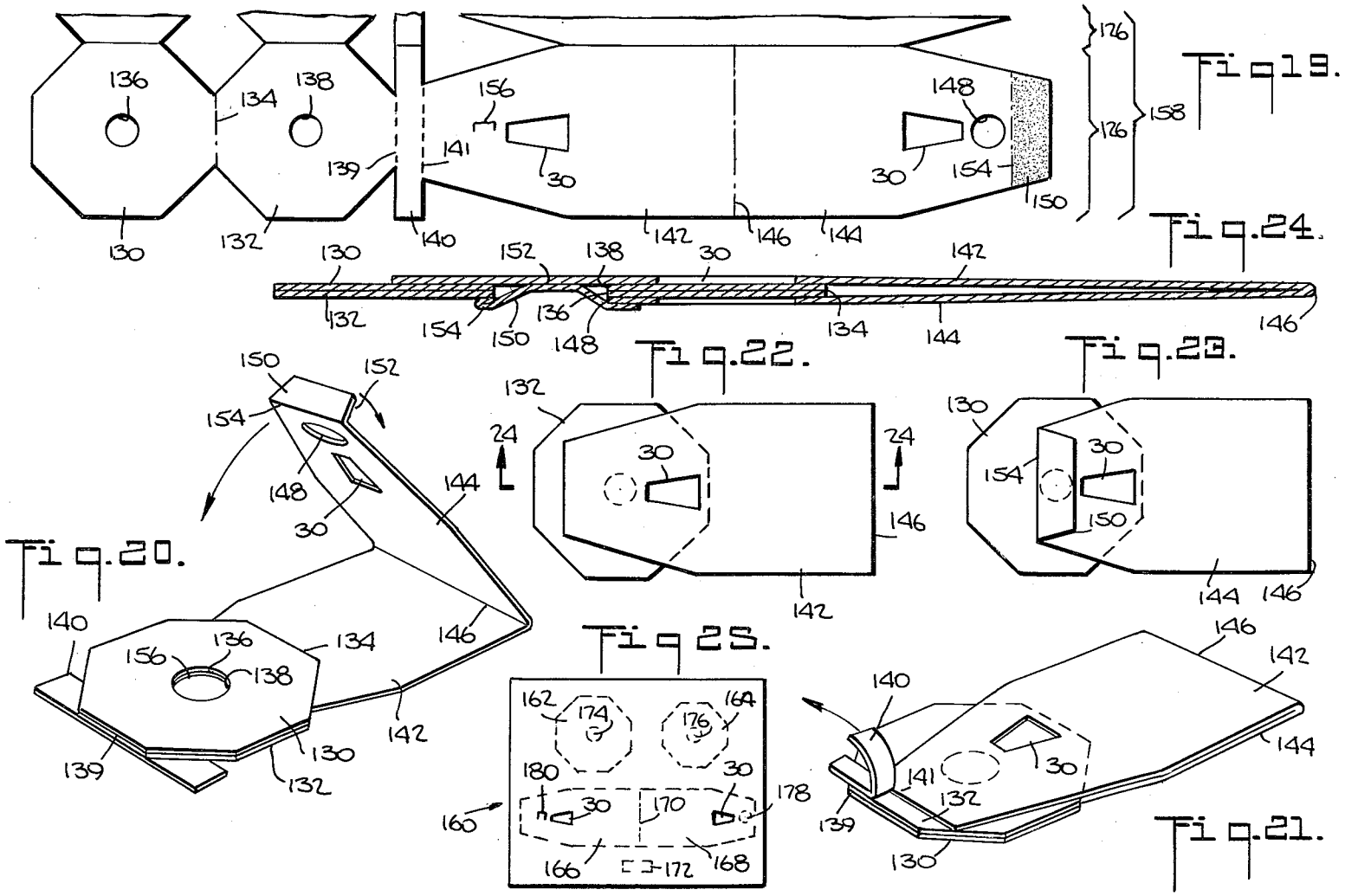
FIGS. 19 through 23 show the construction and assembly of a further embodiment of the invention.
FIG. 24 is a sectional view thereof taken on the line 24—24 of FIG. 22.
FIG. 25 shows a construction for a rotatable wheel assembly similar to that shown in FIGS. 19 through 24.

A construction blank 126 (FIG. 19) for a rotatable wheel assembly 128, as shown in FIGS. 22 through 24, includes a further embodiment of the invention. The construction 126 comprises a pair of octagonally shaped wheel segments 130, 132 hinged together along a common foldable edge portion 134. Each wheel segment 130 and 132 is formed with a respective axial opening 136, and 138. The wheel segments 130 and 132 are joined at a strip member 140 to a pair of cover members 142 and 144. Side edge portions of the strip member 140 are scored at 139 and 141.

The cover members 142 and 144 are hinged together along a common fold line 146. The cover member 144 has an opening 148 and includes a flap 150 formed as an appendage. The flap 150 is provided with an adhesive area 152 (FIGS. 20 and 22) sufficient to cover and extend beyond the cover member opening 148.

In arranging the rotatable wheel assembly 128 the wheel segments 130 and 132 are folded at the common edge portion 134 to layer the segments together and align the axial openings 136 and 138. The layered segments, which can be bonded or otherwise attached together, are folded at the scoreline 139 for disposition upon the cover member 142 as shown in FIG. 20. The cover member 142 is then folded at the fold line 146 for disposition onto the layered wheel segments 130 and 132. The cover member opening 148 is thus aligned with the wheel segment openings 136 and 138.

The flap member 150 is folded at a fold line 154 onto the cover member 144. This enables the adhesive area 152 to bond to a securance portion 156 of the cover member 142 through the aligned axial openings 136 and 138 of the wheel segments 130 and 132. The strip member 140 is then removed as shown in FIG. 21 to permit rotation of the layered wheel segments 130 and 132 with respect to the cover members 142 and 144.

The adhesive bond between the flap 150 and the cover member 142 serves as a pivot for rotation of the layered wheel segments 130, 132 with respect to the cover members 142, 144 and secures the cover members 142 and 144 together as shown in FIG. 24. If desired, the securance portion 156 can have an optional adhesive coating.

Preferably the construction 126 is made in quantity on a web 158 (FIG. 19) arranged to move in the direction of the scorelines 139, 141 and the fold lines 134, 146 and 154, which are parallel to each other. The construction 126 is continuously formed on the web 158 in any suitable known manner and individual blanks 126 are cut from the web 158 in successive order. It will be apparent that all data and other indicia, including advertising, that is printed on one surface of the construction 126 will furnish a readout on opposite sides of the rotatable wheel assembly 128.

A construction similar to the construction 126 can also be formed on an individual construction sheet 160 such as shown in FIG. 25. The sheet 160 includes a pair of wheel segments 162, 164 that can be of identical or different sizes. The sheet 160 further includes a pair of cover members 166, and 168 commonly hinged at 170 that correspond to the cover members 142 and 144. However, the cover member 168 employs a separate adhesive patch member 172 rather than a foldable adhesive flap.

To form a rotatable wheel assembly from the construction sheet 160 the wheel segments 162 and 164 are individually cut as are the adhesive patch 172 and the commonly hinged cover members 166 and 168. Although not shown, the assembly of the construction sheet 160 proceeds by layering the wheel segments 162 and 164 upon each other to align the axial openings 174 and 176 without necessarily bonding the wheel segments 162 and 164 together.

The cover members 166 and 168 are folded at 170, and the layered wheel segments 162, 164 are positioned such that the axial openings 174 align with an opening 178 in the cover member 168. The patch member 172 is sized to span the cover member opening 178 and is applied to the cover member 168. The patch member 172 thus has adhesive engagement with a securance portion 180 of the cover member 166 through the aligned axial openings 174 and 176 thereby securing the cover members 166 and 168 together, and serving as a pivot for rotation of the wheel segments 162 and 164 with respect to the cover members 166 and 168.

As will be apparent to those skilled in the art the separate components of many embodiments of the rotatable wheel assembly as well as the construction thereof can be easily assembled by an adult or child on a do-it-yourself basis. Embodiments of the rotatable wheel assembly wherein cover members are hinged together at a common fold line can also be formed using individually separate cover members that are glued or otherwise bonded together at edge portions that correspond to the common fold line.

Some advantages of the novel invention disclosed herein include a lightweight, relatively inexpensive rotatable wheel assembly and construction therefor, that can be incorporated in a wheel calculator in a preassembled or partially assembled form. The economics inherent in the material, manufacturing and assembly requirements of the invention permit large gratuitous distributions of wheel calculators incorporating embodiments of the invention, for advertising or other promotional purposes.

In view of the above it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A rotatable wheel assembly comprising a pair of generally flat oppositely disposed parallel cover members, a generally flat wheel member sandwiched between said oppositely disposed cover members, said wheel member having an axis of rotation substantially perpendicular to the oppositely disposed cover members and including an axial opening encompassing said axis of rotation, the axial opening of said wheel member not encompassing any pivot disc that is contiguous with said wheel member, and grommetless securing means on at least one of said cover members for securing said one cover member to said other cover member through said axial opening in said wheel member such that the securance of said cover members through said axial opening forms a pivot for rotation of said wheel member substantially about said axis with respect to said cover members.

2. A rotatable wheel assembly as claimed in claim 1 wherein at least one of said cover members is formed of a flexible material and said securing means comprise an adhesive patch on one surface of said one cover member for engagement with said other cover member through the axial opening in said wheel member to adhere said one cover member to said other cover member.

3. A rotatable wheel assembly as claimed in claim 1 wherein each of said cover members includes a heat sealable portion in alignment with the axial opening in said wheel member, said cover members being heat sealed together at said heat sealable portions, such that said heat sealed portions form said pivot for rotation of said wheel member.

4. A rotatable wheel assembly as claimed in claim 1 wherein tab members are formed on one of said cover members, said tab members being aligned with and extending through the axial opening in said wheel member, said other cover member including tab reception means for accommodation of said tab members, the accommodated tab members being folded onto said other cover member to secure said cover members together whereby the tab members define said grommetless securing means.

5. A rotatable wheel assembly as claimed in claim 4 wherein said tab reception means comprise an opening in said other cover member.

6. A rotatable wheel assembly as claimed in claim 5 wherein said opening is of generally rectangular shape.

7. A rotatable wheel assembly as claimed in claim 4 wherein said oppositely disposed cover members have a common joined edge portion at a predetermined distance from said axis of rotation greater than the maximum radial extent of said wheel member from said axis of rotation.

8. A rotatable wheel assembly as claimed in claim 1 wherein at least one of said cover members is formed with an opening in substantial alignment with the axial opening in said wheel member, said grommetless securing means including a separate patch member having an adhesive portion on one surface thereof, said patch member having a diametrical extent larger than the opening in said one cover member to span the opening in said one cover member and maintain adhesive securance to the other said cover member through the axial opening in said wheel member.

9. A rotatable wheel assembly as claimed in claim 8 wherein the opening in said one cover member is smaller than the axial opening in said wheel member.

10. A rotatable wheel assembly as claimed in claim 8 wherein the axial opening in said wheel member has an edge portion covered with a release coating resistant to bonding with the adhesive on said patch member.

11. A rotatable wheel assembly as claimed in claim 2 wherein said oppositely disposed cover members are joined together at corresponding edge portions located a predetermined distance from said axis of rotation greater than the maximum radial extent of said wheel member from said axis of rotation.

12. A rotatable wheel assembly as claimed in claim 11 wherein said joined edge portions are commonly hinged together.

13. A rotatable wheel assembly as claimed in claim 11 wherein said joined edge portions are bonded together.

14. A rotatable wheel assembly as claimed in claim 1 wherein at least one of said cover members is formed with an opening in substantial alignment with the axial opening in said wheel member, said grommetless securing means including a flap formed as an appendage to said one cover member and folded with respect to said one cover member to cover the opening in said one cover member, said flap including an adhesive portion that aligns with the opening in said one cover member when said flap is in said folded position to enable said adhesive portion to maintain adhesive securance to the other said cover member through the axial opening in said wheel member whereby said cover members are secured together.

15. A rotatable wheel assembly as claimed in claim 14 wherein said oppositely disposed cover members have a common joined edge portion at a predetermined distance from said axis of rotation greater than the maximum radial extent of said wheel member from said axis of rotation.

16. A rotatable wheel assembly as claimed in claim 14 wherein said wheel member comprises a pair of wheel segments, each said wheel segment having said axial opening encompassing said axis of rotation, said wheel segments being layered one against the other to permit registered alignment of the axial openings in each said wheel segment.

17. A rotatable wheel assembly as claimed in claim 16 wherein said wheel segments are of identical size.

18. A rotatable wheel assembly as claimed in claim 16 wherein said wheel segments are of different size.

19. A rotatable wheel assembly as claimed in claim 16 wherein said wheel segments have a common joined edge portion and are folded at said common joined edge portion into said layered arrangement.

20. A construction for a wheel assembly comprising a sheet of generally flat flexible foldable material including a wheel member and a pair of cover members formed therein in integral side by side relationship, the wheel member having an axial opening and at least one of the cover members having a securance opening alignable with the axial opening of said wheel member when said construction is in an operable assembled condition, said other cover member incorporating a securance portion alignable with the axial opening of said wheel member when said construction is in said operable assembled condition, said axial opening, said securance opening and said securance portion being disposed colinear in said construction, and grommetless securing means on one of said cover members for securing said one cover member to said other cover member through said axial opening in said wheel member when said construction is in said operable assembled condition.

21. A construction as claimed in claim 20 further including a fold line defined between said cover members.

22. A construction as claimed in claim 21 further including a detachable disposable strip member between said wheel member and said cover members to permit separation of said cover members from said wheel member.

23. A construction as claimed in claim 22 wherein said detachable disposable strip includes a strip fold line to permit folding of said construction into a storage position whereby said folded detachable strip forms an attachment appendage.

24. A construction as claimed in claim 20 further including a foldable flap formed as an appendage of said one cover member, said foldable flap including an adhesive portion colinear with said securance opening and registerable with the securance opening in said one cover member when said construction is in said operable assembled condition.

25. A construction as claimed in claim 20 wherein said wheel member includes two wheel segments separable by a wheel fold line, each said segment having one of said axial openings, said axial openings being registerable with each other when said construction is in said assembled operable condition wherein said wheel segments are folded about said wheel fold line.

* * * * *